US009057973B2

(12) United States Patent
Oshima et al.

(10) Patent No.: US 9,057,973 B2
(45) Date of Patent: Jun. 16, 2015

(54) CHARGING MEMBER AND IMAGE FORMING APPARATUS

(75) Inventors: Nobuo Oshima, Kawasaki (JP); Takayuki Namiki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 245 days.

(21) Appl. No.: 13/314,694

(22) Filed: Dec. 8, 2011

(65) Prior Publication Data

US 2012/0148309 A1 Jun. 14, 2012

(30) Foreign Application Priority Data

Dec. 14, 2010 (JP) ..... 2010-278182
Oct. 28, 2011 (JP) ..... 2011-236965

(51) Int. Cl.
*G03G 15/02* (2006.01)

(52) U.S. Cl.
CPC ..... *G03G 15/0233* (2013.01); *G03G 15/0216* (2013.01); *G03G 2221/183* (2013.01); *G03G 2215/022* (2013.01); *G03G 15/0241* (2013.01); *G03G 15/025* (2013.01)

(58) Field of Classification Search
CPC ..... G03G 15/02
USPC ..... 399/174
See application file for complete search history.

(56) References Cited

U.S. PATENT DOCUMENTS 5,126,913 A 6/1992 Araya et al.
5,535,088 A 7/1996 Sato et al.
5,881,343 A * 3/1999 Momotani et al. ..... 399/174
5,999,773 A * 12/1999 Yasutomi et al. ..... 399/148
6,963,714 B2 * 11/2005 Otomo et al. ..... 399/274
7,639,956 B2 * 12/2009 Naito et al. ..... 399/26
7,692,804 B2 * 4/2010 Naito et al. ..... 358/1.13
2007/0177896 A1 * 8/2007 Okuda ..... 399/128
2009/0180794 A1 * 7/2009 Tanaka ..... 399/100
2012/0148307 A1 * 6/2012 Namiki ..... 399/174
2012/0148308 A1 * 6/2012 Imamura ..... 399/174
2012/0148309 A1 * 6/2012 Oshima et al. ..... 399/174
2013/0170859 A1 * 7/2013 Kishi et al. ..... 399/174

FOREIGN PATENT DOCUMENTS

JP 8062938 * 3/1996 ..... G03G 15/02
JP 9-319183 12/1997
JP 1997-319183 * 12/1997 ..... G03G 15/02
JP 9319183 * 12/1997 ..... G03G 15/02
JP 11-202597 7/1999
JP 2011186034 * 9/2011 ..... G03G 15/02

* cited by examiner

*Primary Examiner* — Clayton E Laballe
*Assistant Examiner* — Kevin Butler
(74) *Attorney, Agent, or Firm* — fitzpatrick, Cella, Harper & Scinto

(57) ABSTRACT

A charging blade for charging a surface of an image bearing drum by contacting thereto includes a charging portion for effecting electric discharge to the surface of the drum; a non-charging portion not effecting the electric discharge to the surface of the drum, wherein the non-charging portion can contact the drum to provide a dischargeable gap between the charge portion and the drum, and at least a part the non-charging portion is made of a substance having a resistance higher than that of the charge portion to prevent no discharge occurs from the non-charging portion to the surface of the drum; and a support for the non-charging portion and the charge portion, wherein the non-charging portion and the charge portion are separation members and are not contacted to each other.

6 Claims, 15 Drawing Sheets

(a)

(b)

(a)

(b)

CHARGING MEMBER AND IMAGE FORMING APPARATUS

FIELD OF THE INVENTION AND RELATED ART

The present invention relates to a blade-like charging member for charging a surface of an image bearing member, the charging member being moved relative to an image bearing member (member to be charged) carrying an electrostatic latent image in contact thereto while being supplied with a voltage, and to an image forming apparatus using the charging member.

Here, a typical example of the image bearing member on which the electrostatic latent image is formed is an electrophotographic photosensitive member or a dielectric member for electrostatic recording. As for the image forming apparatus, there are an electrophotographic type or electrostatic recording type copying machine, printer, facsimile machine or a complex machine thereof, and an image display device or the like.

The description will be made as to a transfer type electrophotographic image forming apparatus, taking for example. Generally, in such an apparatus, the electrostatic latent image of image information is formed by charging means for charging uniformly a surface of the image bearing member (rotatable drum type electrophotographic photosensitive member) to a predetermined polarity and potential and by exposure means for selectively exposing the thus charged drum surface to the light of the image information. The latent image is visualized (developed) into a toner image using a developer (toner) by developing means. The toner image is transferred onto a recording material (recording material) by transferring means. The transferred toner image is fixed by fixing means into a fixed image on the recording material, and then the recording material is outputted as a print.

A recently dominant charging means (charging device) is a contact-charging type means using a fixed type charging member such as a blade or film, or a rotating type charging member such as a brush, roller, belt of semiconductive rubber or resin material. The contact-charging type is advantageous in that it does not necessitate a ozone removing filter because the amount of produced ozone is small and in that a applied voltage required to charge the drum surface up to a predetermined potential can be reduced.

In such a contact charger, in order to charge the drum surface, a DC voltage of −1.0--1.5 kV is applied, by which the drum surface is charged to approx. −500V. In addition, in order to improve the stability, an AC voltage may be superimposed on the DC voltage.

The contact charger involves a problem of contamination of the charger. More particularly, the toner and/or an externally added material which remains on the drum without being transferred and which is supposed to be removed by a cleaning member is not necessarily completely be removed. So, the toner and/or the externally added material having passed by the cleaning member reaches the contact type charger with the result of contamination of the charger. Then, the uniform discharge is not accomplished, and therefore, an improper charging such as longitudinal stripes or non-uniformity discharge occurs.

In the non-contact type charger (not the corona charger) for charging the drum surface without contact thereto, it is considered that the discharging gap is minimized in order to minimize the production of the ozone and in order to minimize the contamination.

That is, in order to minimize the ozone amount and minimize the applied voltage, the small but dischargeable gap has to be assured. In consideration of the vibration and the diameter of the drum, in order to assure the small gap, a part of the charger is usually contacted to the drum, so that the gap is assured by an abutment member contacting the drum.

The material of the abutment member is flexible material in order to avoid the damage to the drum surface and to avoid the influence to the charging. In order to provide widest possible discharge region, the charge portion is at a part closest to the free end portion. Therefore, usually, the free end portion and the charge portion are contacted to each other (for example, Japanese Laid-open Patent Application Hei 9-319183, Japanese Laid-open Patent Application Hei 11-202597).

With such a structure, however, small vibration is produced with rotation the drum at the contact portion with the drum. The vibration propagates directly to the charge portion with the result of non-uniform charging.

Referring to FIG. 12, behavior of the free end portion 41 of the flexible member of the blade-like charging member (charging blade) will be described. The free end portion 41 of the charging blade which is made of a flexible material (elastic member) contacts to the drum 3 which is rotated in the direction indicated by A. By the friction f with the drum 3 at the free end portion 41, the free end portion 41 tends to be deformed in the rotational moving direction A when the friction force f is large ((a), (b)).

Then, the restoring force F of the elastic member exceeds the frictional force f, and the free end portion 41 tends to restore the original state ((c) and (d)). Thus, the free end portion 41 repeats stick and slip.

By the repeated stick and slip, the small vibration is produced at the free end portion 41 where the charging blade contacts to the drum 3. As long as the charging member is contacted to the drum 3, such a vibration is unavoidable. Particularly, if the contact is edge contact, the vibration tends to be large.

And, the vibration propagates a charge portion 51 (FIG. 13) of the charging blade adjacent to the free end portion 41, thus varying the discharge gap in the charge portion 51. The discharge gap is normally 7.5-150 μm which is enough to provide a satisfactory charging, and therefore, the change in the discharge gap may result in the improper charging such as charging non-uniformity.

Reference to FIG. 13, the state at this time will be described. In part (a) of FIG. 13, the free end portion 41 of the charging blade is about to be deformed by the frictional force f with the drum 3. The charge portion 51 adjacent to the free end portion 41 is deformed, too, by the deformation of the free end portion 41 by the frictional force f ((b)). Therefore, the discharge gaps 53, 54 vary. The minimum discharge gap is indicated by 53, and the maximum discharge gap is indicated by 54, and designated by 55 is the discharge region.

Thus, the discharge gap changes in interrelation with such stick and slip of the free end portion 41, thus changing chargeable region 55. Therefore, further improvement is desired.

SUMMARY OF THE INVENTION

It is a further object of the present invention to provide a blade-like charging member with which a variation of a discharge gap produced by a vibration (stick and slip) of a free end portion is suppressed to provide a stabilized charging, and an image forming apparatus using the charging member.

According to an aspect of the present invention, there is provided a blade-like charging member for charging a surface of an image bearing member by contacting thereto and by being supplied with a voltage, said charging member comprising a charging portion for effecting electric discharge to the surface of the image bearing member; a non-charging portion not effecting the electric discharge to the surface of the image bearing member, wherein said non-charging portion is capable of contacting said image bearing member to provide a dischargeable gap between said charge portion and said image bearing member, and at least a part said non-charging portion is made of a substance having a resistance higher than that of said charge portion to prevent no discharge occurs from said non-charging portion to the surface of said image bearing member; and a supporting portion supporting said non-charging portion and said charge portion; wherein said non-charging portion and said charge portion are separation members and are not contacted to each other.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated. The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

(1) General Structure of an Example of an Image Forming Apparatus and an Image Forming Operation Thereof:

This application claims priority from Japanese Patent Applications Nos. 278182/2010 and 236965/2011 filed Dec. 14, 2010 and Oct. 28, 2011, respectively which are hereby incorporated by reference.

Figure 2:
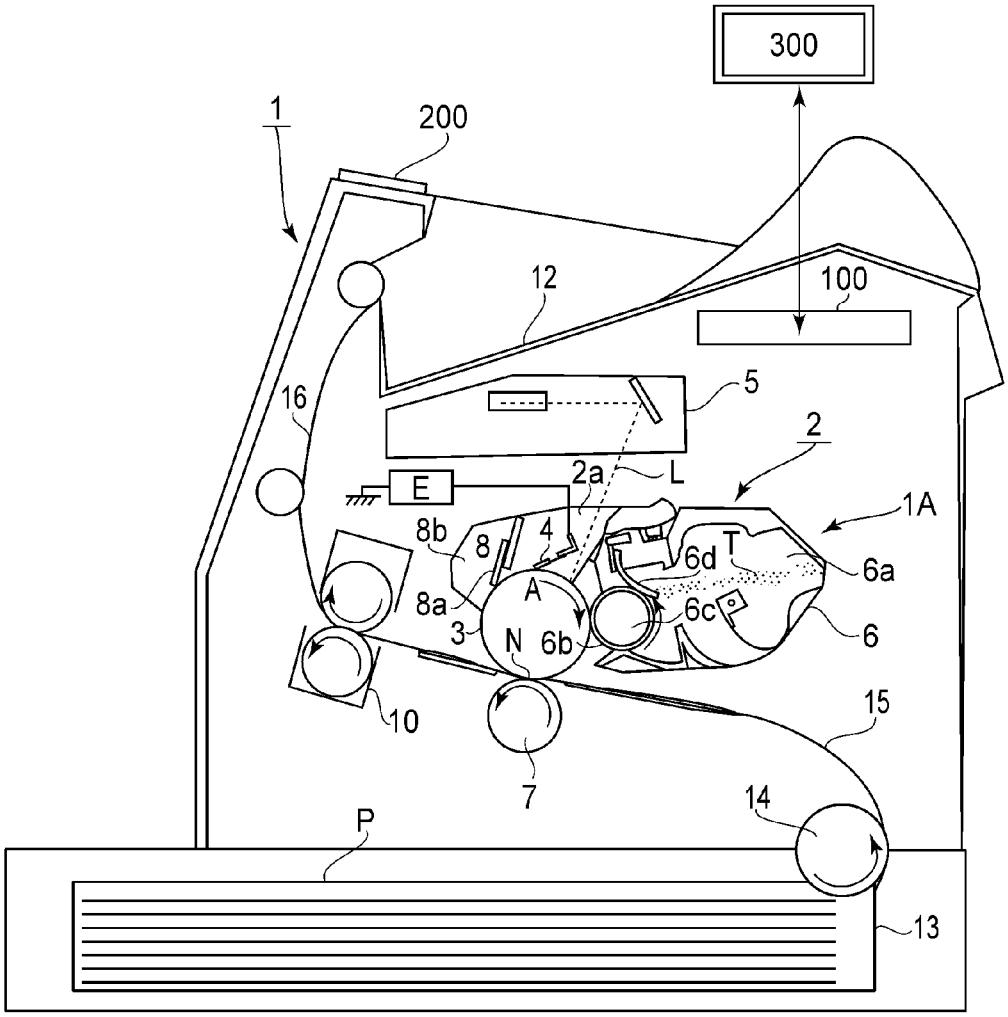
FIG. 2 is a schematic view of an example of an image forming apparatus.

FIG. 2 is a schematic illustration of an example of an image forming apparatus 1 using a blade-like charging member 4 according to an embodiment of the present invention. An apparatus 1 is a process cartridge mounting and demounting type electrophotographic image forming apparatus (printer) using an electrophotographic process. The apparatus 1 forms an image on a recording material (recording material) P on the basis of an electrical image signal inputted to a control circuit portion (control means, CPU) 100 from a host apparatus 400 such as a personal computer, an image reader or a facsimile machine.

The recording material P is a sheet on which an image can be formed by an electrophotographic process, and is a sheet of paper, a resin material sheet, a label or the like. The control circuit portion 100 exchange various electrical information with an operating portion 200 or the host apparatus 400, and controls overall image forming operation of the apparatus 1 in accordance with predetermined control program and reference table stored in a storing portion.

In a main assembly of the apparatus of the device 1, there is provided a cartridge accommodating portion 1A. A process cartridge 2 is demountably mounted to the cartridge accommodating portion 1A through a predetermined operation manner. In this embodiment, the cartridge 2 is an integral type process cartridge. More particularly, an electrophotographic photosensitive drum 3 as an image bearing member on which an electrostatic latent image developed with a developer T is formed, and charging means actable on the drum 3 are mounted to a common casing into a unit.

In this embodiment, the charging means 4 is a charging blade (blade-like charging member). The charging blade 4 will be described hereinafter. The developing means 6 is a non-contact-type developing device operable with one component magnetic toner as the developer T. In the following, the developer T will be called toner, too. The toner T used in this embodiment comprises a base material and a plurality of externally added materials, and one component magnetic negative charged toner having an average particle size of 8 μm. The cleaning means 8 is a blade cleaning device using an elastic cleaning blade 8*a* as the cleaning member.

The developing device 6 includes a developing container 6*a* as a developer accommodating portion accommodating the toner T. It also includes a developing sleeve 6*b* as a developer carrying member for developing an electrostatic latent image formed on the drum 3 into a toner image, a non-rotatable magnet roller 6*c* provided in the sleeve 6*b*, a developing blade 6*d* for regulating an amount of the toner on the developing sleeve 6*b*, and so on.

Above the cartridge accommodating portion 1A, there is provided a semiconductor laser scanner 5 as image exposure means. The unit 5 outputs a laser beam L modulated in accordance with the image information inputted to the control circuit portion 100 from the host apparatus 300. The laser beam L enters the cartridge 2 through an exposure window 2*a* provided in a top side. By doing so, the surface of the drum 3 is scanningly exposed to a laser beam.

To the drum 3 in the cartridge 2, a transfer roller 7 is contacted to form a transfer nip N. The cartridge 2 accommodated in the cartridge accommodating portion 1A is urged to a positioning portion (unshown) in the main assembly side of the apparatus by an urging means (unshown) is correctly positioned. In addition, a drive outputting portion (unshown) of the main assembly side of the apparatus is connected to a drive inputting portion (unshown) of the cartridge 2. To various electrical contacts (unshown) of the cartridge 2, the corresponding electrical contacts (unshown) of the main assembly side of the apparatus are contacted.

The image forming operation is as follows. The drum 3 is rotated in the clockwise direction indicated by arrow A at a predetermined peripheral speed, that is, 100 mm/sec in this embodiment. The unit 5 is also driven. In synchronism with the drive, a predetermined charging bias voltage is applied from a charging bias voltage applying source E to the charging blade 4 at predetermined control timing so that the surface of the drum 3 is charged uniformly to the predetermined polarity and potential by the charging blade 4 by a non-contact type charging. The unit 5 scans and exposes the surface of the drum 3 by a laser beam L modulated in accordance with the image signal. By this, an electrostatic latent image is formed in accordance with the image signal on the surface of the drum 3.

The electrostatic latent image thus formed is developed into a toner image by the toner carried on the developing sleeve 6*b* of the developing device 6. The developing sleeve 6*b* is rotated in a counterclockwise direction indicated by an arrow at a predetermined speed. To the developing sleeve 6*b*, a predetermined developing bias voltage is applied at predetermined control timing from a developing bias applying voltage source portion (unshown).

On the other hand, one recording material P is separated and fed out of a sheet feeding mechanism portion (unshown) 13 by a sheet feeding roller 14. The recording material P is introduced into the transfer nip N at the predetermined control timing through a sheet path 15 including registration means (unshown) and is nipped and fed through the nip N. During the recording material P moving the nip N, a predetermined transfer bias is applied to the transfer roller 7 from a transfer bias application voltage source portion (unshown). By this, the toner image is transferred from the drum 3 onto the surface of the recording material P sequentially.

The recording material P having passed through the nip N is separated from the surface of the drum 3 and is introduced into the fixing device 10. In this embodiment, the fixing device 10 is a heat roller fixing device, and the recording material P is nipped and fed by a fixing nip and is subjected to heat and pressure. By this, the unfixed toner image on the recording material P is heat-pressure fixed into a fixed image. The recording material P discharged from the fixing device 10 is discharged from the apparatus 1 as a print onto a sheet discharge tray 12.

The untransferred toner remaining on the drum 3 without being transferred onto the recording material P in the transfer nip N is scraped by a cleaning blade 8*a* of a cleaning device 8, and is accommodated in a residual toner container 8*b*. The cleaned drum 3 is used repeatedly for image formation.

Figure 3:
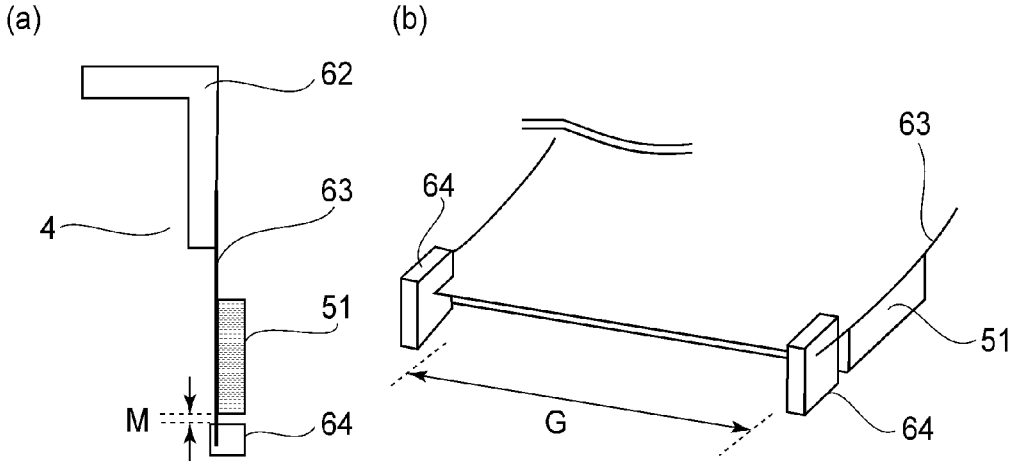
FIG. 3 is an illustration a charging blade.

(2) Charging Blade:

FIG. 3 is an illustration of the charging blade 4 of this embodiment. The charging blade 4 of this embodiment contacts the drum 3 and moves relative thereto, and a voltage is applied thereto by which the surface of the drum 3 is charged. It comprises a charging portion 51 for effecting discharge to the surface of drum 3, and a non-charging portion 64 which does not effect the discharge to the surface of drum 3. The non-charging portion 64 is contacted to the drum 3 by which a dischargeable gap α (part (b) of FIG. 1) is formed between the charge portion 51 and the drum 3.

At least a part of the non-charging portion 64 is made of a high resistance material having a resistance higher than that of the charging portion 51 to prevent discharge between the non-charging portion 64 and the surface of the drum 1. The charging blade 4 includes a supporting portion 63 supporting the non-charging portion 64 and the charge portion 51, and the non-charging portion 64 and the charge portion 51 are separate members and are not contacted with each other.

The detailed description will be made. The supporting portion 63 is an electroconductive elastic supporting member functioning also as an electrode plate, and in this embodiment, it is made of phosphor bronze plate (metal member) having a thickness of 100 μm. The supporting portion 63 is elongate in the direction of a generatrix of the drum 3 (drum axis direction) and has a length corresponding to the entire range of the width G of the image forming region of the drum 3. A base side of the supporting portion 63 (one end portion of the supporting portion 63 with respect to a widthwise direction) is held by a holder 62.

The holder 62 is made of a rigid metal plate in this embodiment, and is electrically conduced with the supporting portion 63. The non-charging portion 64 is provided at a free end portion of the supporting portion 63 (remote from the holder 62 side) and functions as a free end portion (abutment member) of the charging blade. In this embodiment, the non-charging portion 64 is made of urethane rubber (insulative member).

<Non-Charging Portion 64>

Figure 1:
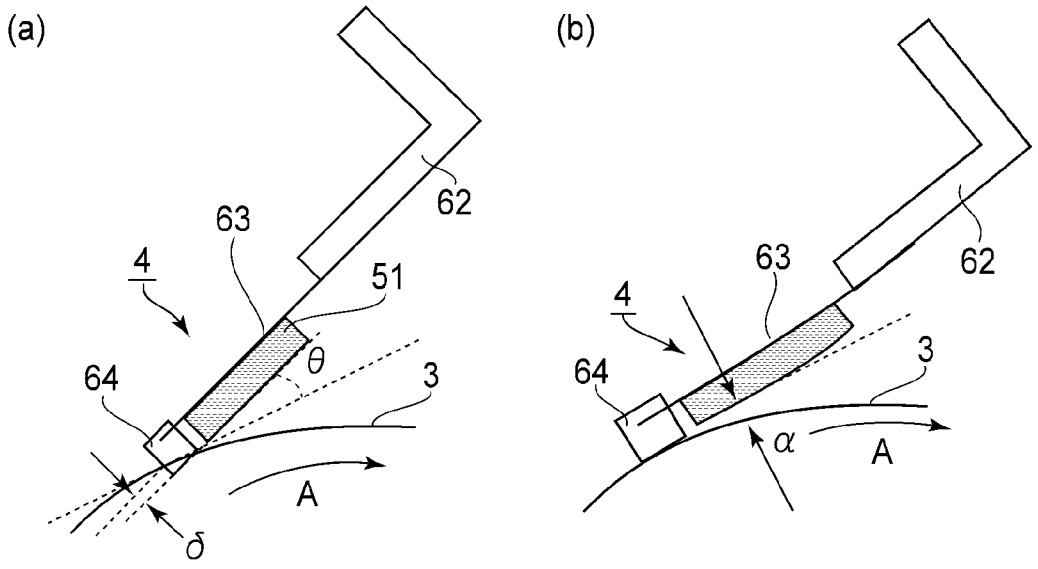
FIG. 1 is an illustration of setting of a charging blade relative to a drum according to Embodiment 1.

The non-charging portion 64 as the abutment member functions to position the charge portion 51 so as to assure the dischargeable gap α (part (b) of FIG. 1) by contacting the drum 3. Therefore, the non-charging portion 64 is not required to extend all over the entire longitudinal range of the supporting portion 63, and as shown in part (b) of FIG. 3, it can be provided at the end (outside the image region) if it can assure the discharge distance in charge portion 51.

By using the non-charging portion 64 of an insulative material, it can be assured that the discharge is prevented outside the charge portion 51. In addition, what is required is that no discharge occurs from the non-charging portion 64, and therefore, it is not inevitable that the entirety of the non-charging portion 64 is made of insulative material.

Figure 4:
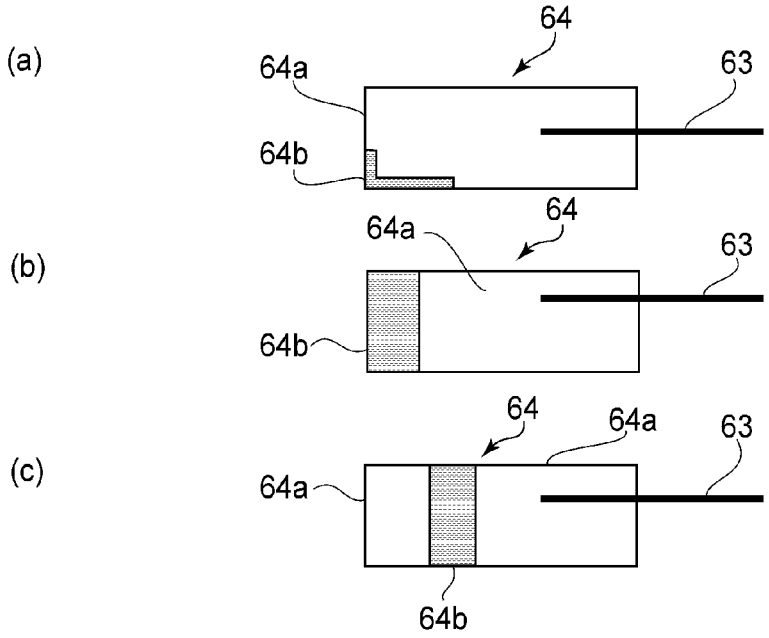
FIG. 4 is an illustration of various modified examples of the non-charging portion (free end portion).

As shown in parts (a) and (b) of FIG. 4, for example, the non-charging portion 64 may be a composite member comprising an insulative member 64*a* and an electroconductive member 64*b*, and the free end has an electroconductive member 64*b*. The electroconductive member 64*b* is electrically insulated from the supporting portion 63 which is an electrode plate, by the insulative member 64*a*. In addition, as shown in part (c), the electroconductive member 64*b* may be provided in the middle of the insulative member 64*a*, wherein the electroconductive member 64*b* is electrically insulated from the supporting portion 63 which is the electrode plate, by the insulative member 64*a*. Since the non-charging portion 64 contacts the drum surface, the damage to the drum surface is prevented by employing an elastic member material.

<Charge Portion 51>

On the side of the supporting portion 63 opposed to the drum 3 is provided with the charge portion 51 extending along the length of the supporting portion 63 to charge electrically the drum surface, using the electrical discharge. In this embodiment, the charge portion 51 is made of intermediate resistance electroconductive rubber, and is connected with the supporting portion 63 by an electroconductive adhesive material. Therefore, the charge portion 51 is electrically conducted with the supporting portion 63. In addition, the supporting portion 63 is electrically conducted with the holder 62.

The electroconductive rubber of the charge portion 51 has a resistance of approx. 10^8 Ωcm. Since the charge portion 51 is made of electroconductive rubber, it is an elastic member. By this, it is avoided that the damage is imparted to the drum 3 by the charging member unexpected hitting the drum 3 upon falling, for example, in view of the smallness of the gap to reduce the charged potential.

The non-charging portion 64 and the charge portion 51 are separate members which are not contacted to each other, and are mounted commonly on the supporting portion 63. That is, the non-charging portion 64 and the charge portion 51 are mounted on the supporting portion 63. Since the non-charging portion 64 and the charge portion 51 are mounted on the common member, the position of the charge portion 51 is determined by the abutment portion relative to the drum 3. In addition, since the non-charging portion 64 and the charge portion 51 are not contacted to each other, the charge portion 51 is substantially free of the vibration of the non-charging portion 64 (abutting portion).

Moreover, the productivity of the charging blade is high since there is no need of bonding different materials (the non-charging portion 64 and the charge portion 51). The gap M between the non-charging portion 64 and charge portion 51 is 1 mm in this embodiment (part (a) of FIG. 3). This gap is so determined that the non-charging portion 64 assures the dischargeable gap 7.5-150 μm between the charge portion 51 and the drum 3 during the drum driving.

<Charging Blade Setting>

Referring to FIG. 1, the setting of said charging blade 4 relative to the drum 3 in this embodiment will be described. Charging blade 22 is disposed parallel to the generatrix direction of the drum 1. The charging blade 22 is provided counterdirectionally with respect to a rotational moving direction R of the drum 1 during the image forming operation. An edge portion of the non-charging portion 64 is contacted to the drum 3, the holder 62 is fixed to the casing (unshown) of the cartridge 2, and the edge portion is contacted to the drum 3 at a predetermined urging force by a supporting portion 63.

In the contact state, the charge portion 51 is disposed opposed to the drum 3 without contact thereto. And, the discharging position of the charging portion 51 is out of contact with a dischargeable gap g from the drum 1. The predetermined charging bias voltage is applied to the electroconductive holder 62 from charging bias voltage applying source E (FIG. 2), and the bias voltage is applied to the charging portion 51 through the holder 62 and the supporting member 63.

By this, the discharge occurs to the surface of drum 3 across the small gap g between the charging portion 51 and the drum 3 to charge uniformly the surface of the rotating drum 3 to the predetermined polarity and potential. In this embodiment, a DC voltage of −1.0 kV is applied from the voltage source E to the charge portion 51 to charge the drum surface to approx. −500V.

Figure 5:
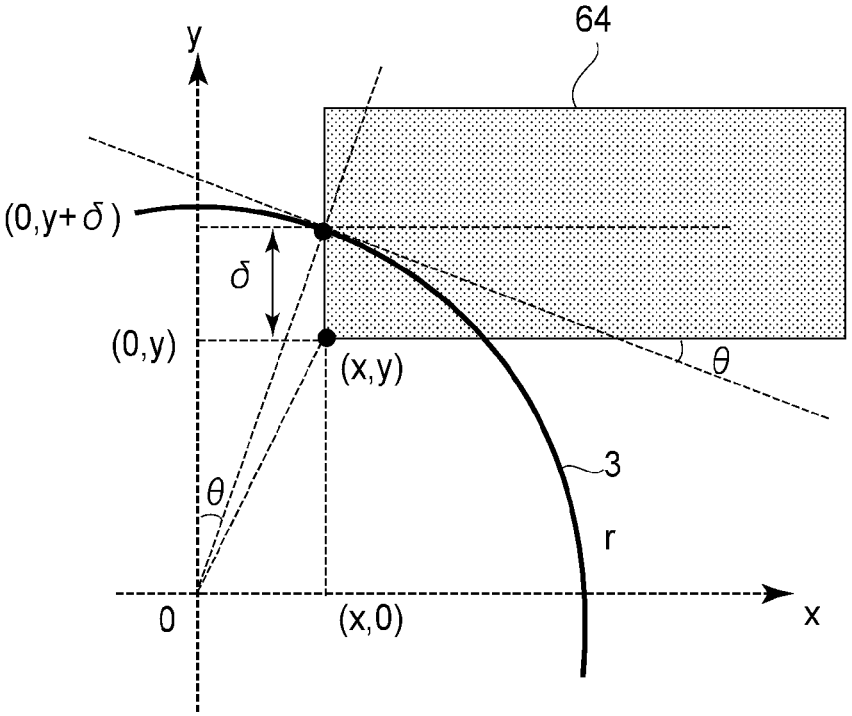
FIG. 5 is an illustration of a measuring method for a set angle θ and a virtual bite δ.

In this embodiment, the charging blade 4 is edge-contacted to the drum 3 with the set angle θ=24° and the virtual bite δ=0.5 mm. Referring to FIG. 5, the determination of the set angle θ and the virtual bite δ will be described. The set angle θ and the virtual bite δ is measured in a state in which the drum 3 is removed from the combination of the charging blade 4 and the drum 3 during the image formation. In FIG. 5, a phantom drum 3 is indicated as the drum existing during the image formation. X axis passes through the center of the phantom drum and is parallel with such a plane including a free end edge of the charging blade 4 as is opposed to the drum 3.

Y axis is perpendicular to the X shaft and passes through the center of the phantom drum 3. Coordinate (X, Y) of the free end of the charging blade 22 is determined. From the coordinate and the radius r of the phantom drum 3 the virtual bite δ and the setting angle θ can be obtained by equation (1) and equation (2).

$$\delta=\sqrt{(r^2-x^2)}-y \quad (1).$$

$$\theta=\arcsin(x/r) \quad (2)$$

The charge portion 51 is maintained with a gap α in a range of dischargeable gap of 7.5-150 μm relative to the drum 3. In addition, the contact angle θ and the virtual bite δ are selected in view of the fact that the wider the discharge region, the charging operation is stable.

<Vibration of the Charging Blade During Drum Driving>

During the rotation of the drum, a vibration (repetition of stick and slip) of the non-charging portion 64 is caused by the friction between the drum 3 and the non-charging portion 64 which is at the free end portion (abutting portion) of the charging blade. By the friction relative to the drum, the non-charging portion 64 is deformed, and the restores, and it is repeated. If the non-charging portion 64 and the charge portion 51 are contacted to each other, the vibration propagates to the charge portion 51 since they are both elastic.

Figure 6:
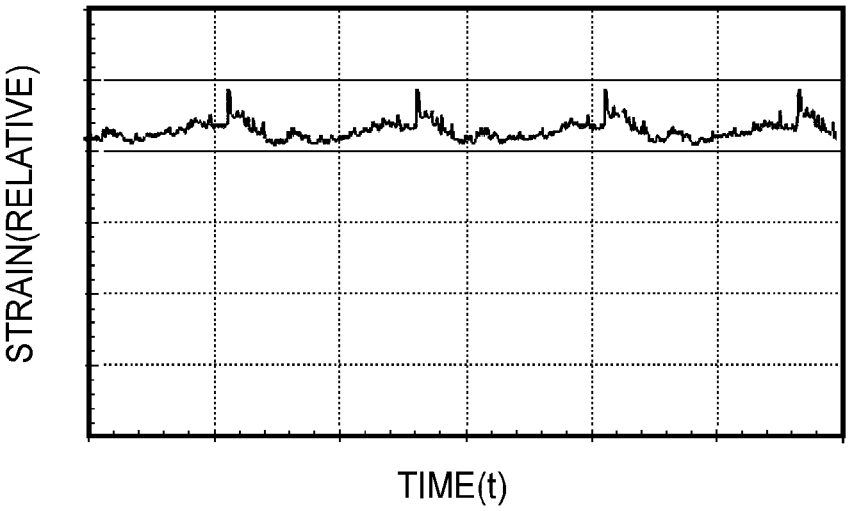
FIG. 6 is a graph of vibration of a non-charging portion.

Referring to FIG. 6, there is shown an actual vibration of the non-charging portion 64. The abscissa is measuring time, and the ordinate is a strain (relative value). In accordance with a periodical strain caused by rotation of the drum 3, there are superposed small strain changes. The small changes cause the improper charging, but the non-contact feature between the charge portion 51 and the non-charging portion 64 is effective to reduce the propagation of the vibration of the non-charging portion 64 to the charge portion 51.

Figure 7:
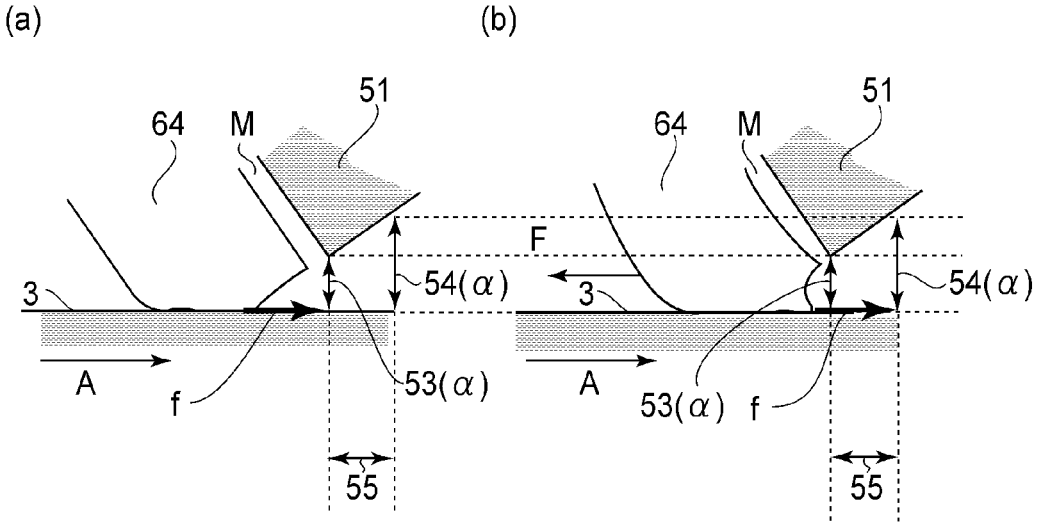
FIG. 7 is a schematic view of behavior of the non-charging portion.

Parts (a) and (b) of FIG. 7 illustrate motion of the non-charging portion 64 when the non-charging portion 64 and the charge portion 51 are not contacted to each other. The non-charging portion 64 is contacted to drum 3, it is deformed by the frictional force f relative to the drum 3. Therefore, the non-charging portion 64 is produced in the stick and slip motion.

However, as shown in part (b), the charge portion 51 is not contacted with the non-charging portion 64, and therefore, the deformation of the non-charging portion 64 does not propagate beyond the gap M (between the non-charging portion 64 and the charge portion 51) to the charge portion 51. For this reason, the discharge gap 53, 54 (α) in the charge portion 51 remains constant irrespective of the stick and slip motion of the non-charging portion 64, by which the charging property is maintained constant.

<Verification Experiment>

Verification experiments about improvement in the charging property by the embodiment were carried out. The ambient conditions of the experiments were 23□ of the temperature and 50% of the humidity. A charging voltage of DC −1.0 kV is applied, and occurrence of improper charging is checked. For the checking, the drum 3 is charged to the −500V, and the developer (toner) is supplied to the charged drum 3 with different developing bias voltages, and then the potential non-uniformity of the drum can be observed as non-uniformity of the toner image.

The experiments were carried out for 1) a charging blade in which the non-charging portion 64 and the charge portion 51 are contacted to each other (comparison example) (and), 2) a charging blade (this embodiment) in which the non-charging portion 64 and the charge portion 51 are not contacted to each other (this embodiment). With the comparison example, non-uniformity in the form of lateral stripes are observed, but with this embodiment, no such lateral stripes are observed.

Thus, it has been confirmed that by the non-charging portion 46 and the charge portion 51 being supported on the common supporting portion 63 without contact to each other, the uniform charging can be accomplished independently of the vibration of the non-charging portion 46.

Embodiment 2

Figure 8:
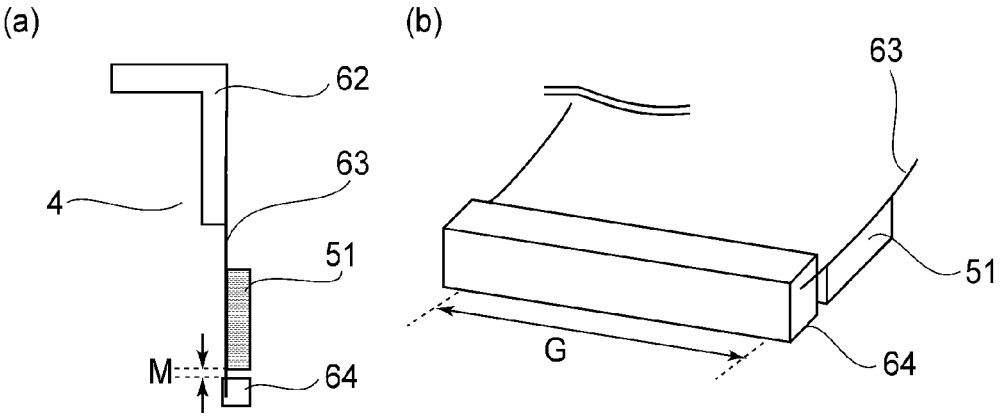
FIG. 8 is a schematic view of a charging blade according to Embodiment 2.

In Embodiment 1, the non-charging portion 46 for the positioning is provided only at each of the longitudinal ends of the charging blade, but in this embodiment, the non-charging portion 46 extends all over or beyond the image forming region width G of the drum 3, as shown in part (b) of FIG. 8. That is, the non-charging portion 46 slidingly contacts the surface of drum 3 all over the width G of the surface of drum 3. The other structures of the charging blade and the setting thereof relative to the drum 3 are similar to those of Embodiment 1.

In the charging blade 4 of this embodiment, the stick and slip motion of only a part of the longitudinal range may propagate widely to the neighborhood of the part. The effects of non-contact arrangement between the non-charging portion 46 and the charge portion 51 are more significant than in Embodiment 1. The verification experiments were carried out similarly to Embodiment 1. It has been confirmed that with the charging blade 4, the lateral stripes due to the charging non-uniformity do not occur similarly to the charging blade of Embodiment 1.

Embodiment 3

In Embodiment 2, the non-charging portion 46 functions also as a removing member for removing contamination of the charge portion 51, but in the present embodiment, non-charging portion 46 functions also as a cleaning member for the drum 3, and it contacts the drum over the image forming region width G. In this embodiment, a cleaning blade 8*a* of a cleaning device 8 functions as a charging and cleaning blade 4.

Similarly to the charging blade 4 of Embodiment 2, the non-charging portion 46 extends over or beyond the entire range of the image forming region width G of the drum 3 along the length of the drum 3. The non-charging portion 46 functions also as the cleaning member for cleaning the surface of the drum to remove the toner and the externally added material. In this embodiment, the contact angle θ=24° and the virtual bite δ=0.8 mm so as to clean the surface of the drum. The charge portion 51 is maintained with a gap α in a range of dischargeable gap of 7.5-150 μm relative to the drum 3. The other structures of the charging blade 4 and the setting relative to the drum 3 of this embodiment and similar to those of the charging blade 4 of Embodiment 2.

The charging blade 4 of this embodiment functions also as a cleaning member for cleaning the drum surface, the vibration is larger as compared with the contamination removing function for the charge portion 51 in Embodiment 2. The effect of suppression of the propagation of the vibration by the non-contact between the non-charging portion 46 (cleaning portion) and the charge portion 51 is significant. The verification experiments were carried out similarly to Embodiment 1. With the cleaning and charging blade 4 of this embodiment, no lateral stripes due to the charging non-uniformity are produced, similarly to Embodiments 1, 2.

From the foregoing by mounting the cleaning portion 46 and the charge portion 51 of the cleaning and charging blade to the common supporting portion 63 without contact to each other, the uniform charging is accomplished independently of the vibration of the cleaning portion 46.

Embodiment 4

In this Embodiment 4, the charging blade 4 is a cleaning and charging blade similarly to the Embodiment 3. In Embodiment 3, the supporting portion 63 of the charging blade 4 is a flexible (elastic) member, but in this embodiment, the supporting portion 63 is a rigid member.

Figure 9:
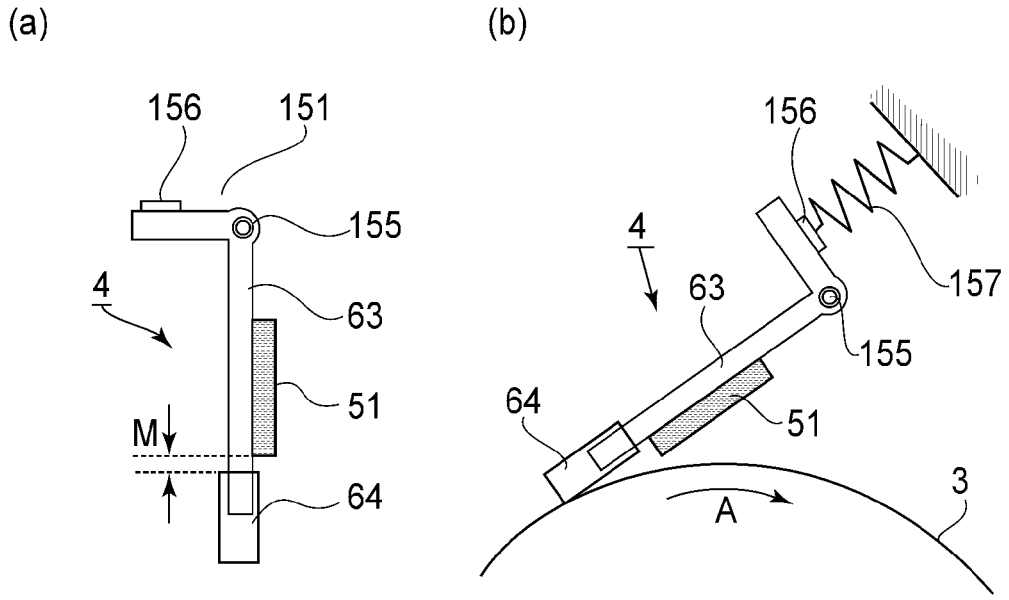
FIG. 9 is a schematic view of a charging and cleaning blade according to Embodiment 4.

FIG. 9 is an illustration of the cleaning and charging blade 4 of this Embodiment 4. The supporting portion 63 of the charging blade 4 in this embodiment is a steel plate having a thickness of 1 mm. To the supporting portion 63, a non-charging portions 64 as cleaning member and a charge portion 51 are mounted so that they are not contacted to each other, similarly to the charging blade 4 of Embodiment 3. In this embodiment, it is edge contacted to the drum 3 with the contact angle θ=24° and the virtual bite δ=0.8 mm. The charge portion 51 is maintained with a gap α in a range of dischargeable gap of 7.5-150 μm relative to the drum 3. The other structures of the charging member and the setting relative to the drum 3 are similar to the charging blade 4 of Embodiment 3.

The non-charging portion 64 as the cleaning portion and the charge portion 51 are mounted to the common supporting portion 63, and are not contacted to each other so as to avoid influence of the vibration of the non-charging portion 64 to the charge portion 51. Thus, since the cleaning portion at the free end and the charge portion are not contacted to each other, the vibration of the non-charging portion 64 does not directly propagate to the charge portion.

Here, the vibration of the non-charging portion 64 may propagate by way of the supporting portion 63 in addition to the direct propagation between the elastic members. In this embodiment, the supporting portion 63 is made of the steel plate, and therefore, the vibration of the non-charging portion 64 is not absorbed by the supporting portion 63, and all the vibration of the supporting portion 63 propagates to the charge portion 51.

Figure 10:
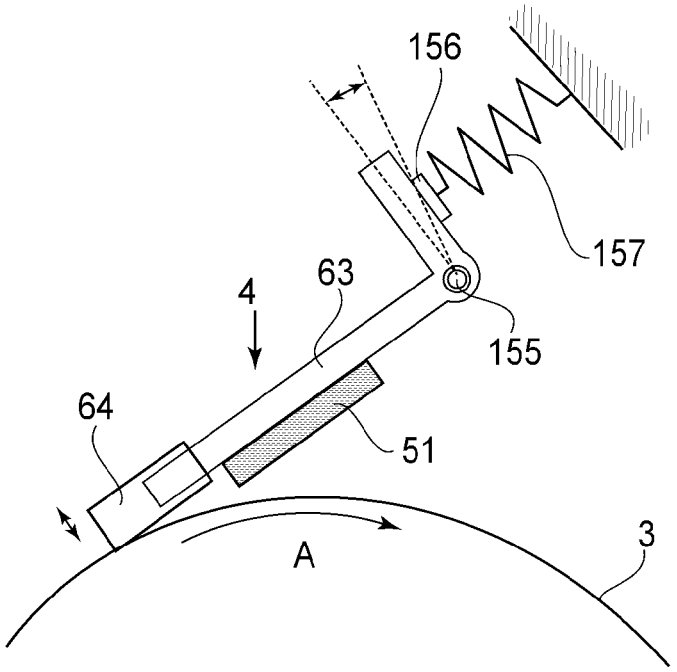
FIG. 10 is a schematic view of behavior of the charging and cleaning blade.

In view of this, the vibration is absorbed by the provisions of a link portion (hinge portion, pivot portion) 155, a spring receiving portion 156 and a spring member 157 so as to absorb the vibration. The spring member 157 may cover the entire longitudinal range, but in this embodiment, the spring members 157 are provided at two end points, respectively, by which the vibration propagating to the supporting portion 63 is absorbed by the spring member 157. As shown in FIG. 10, the spring member 157 absorbs the vibration about the link portion 155, and the variation of the discharge gap in the charge portion 51 is suppressed.

The verification experiments were carried out similarly to Embodiment 1. With the cleaning and charging blade 4 of this embodiment, no lateral stripes due to the charging non-uniformity are produced, similarly to Embodiment 3.

Embodiment 5

In this Embodiment 5, the charging blade 4 is a cleaning and charging blade similarly to the Embodiment 4. A supporting portion 63 of the charging blade 4 of Embodiment 5 is made of flexible material, and the rigidity of the supporting portion 63 is enhanced by the shape to reduce the vibration.

Figure 11:
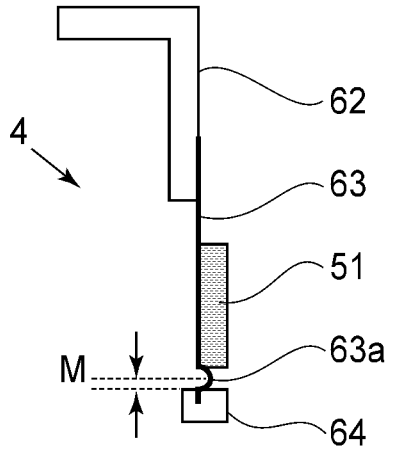
FIG. 11 is a schematic view of a charging and cleaning blade according to Embodiment 5.
Figure 12:
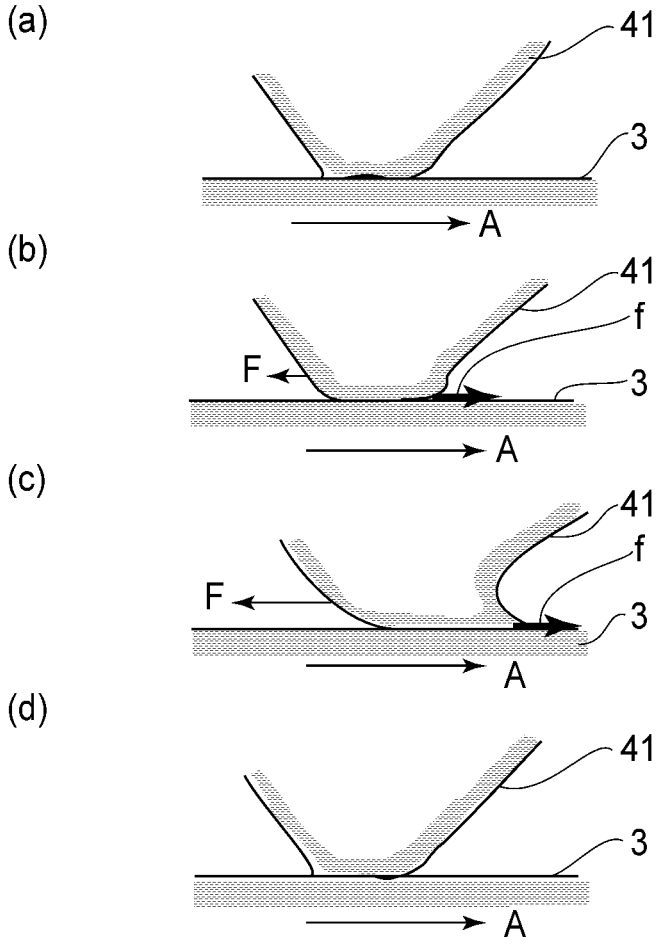
FIG. 12 is a schematic view of stick and slip.
Figure 13:
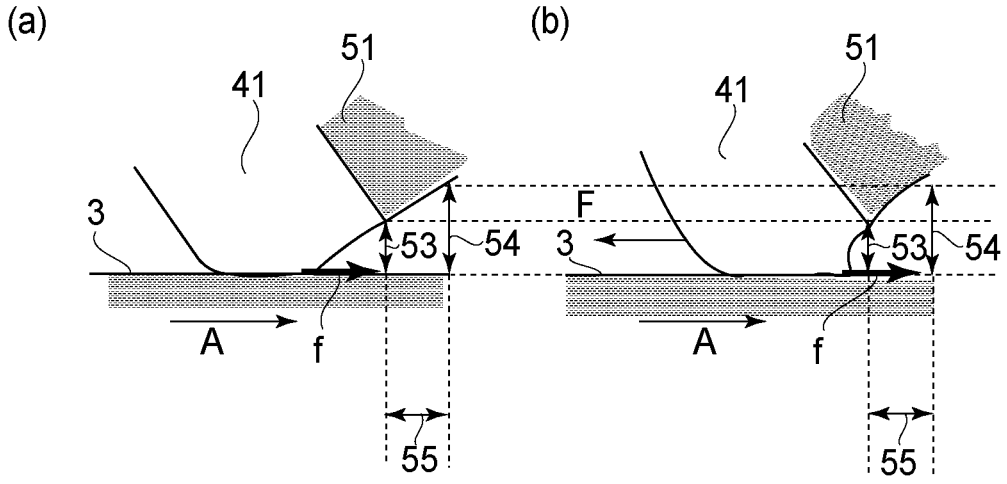
FIG. 13 is a schematic view of the change of a discharge gap due to the stick and slip.

FIG. 11 illustrates an illustration of the charging blade 4 of this embodiment, the gap M between the non-charging portion 64 as cleaning portion and the charge portion 51 which is 1 mm in Embodiment 3 is increased to 2 mm. The supporting member 63 has an arcuate bead portion 63*a* having a radius of 1 mm at the gap between the cleaning portion and the charge portion so as to enhance the rigidity of the supporting portion per se. The vibration directly propagated from the non-charging portion 64 (cleaning portion) to the charge portion 51 is reduced through or not through the supporting portion 63. The other structures of the charging member and the setting relative to the drum 3 are similar to the charging blade 4 of Embodiment 3.

By the provision of the bead portion 63*a*, the rigidity of the supporting portion 63 can be enhanced. By enhancing the rigidity of the supporting portion 63, the vibration propagated through the supporting portion 63 can be suppressed. Here, the phosphor bronze of the supporting portion 63 is flexible, and therefore, it is not a rigid member having a sufficient rigid as in Embodiment 4. For this reason, it can absorb a certain degree of the vibration, and a member such as a spring member 157 as in Embodiment 4 is unnecessary, and therefore, the vibration of the non-charging portion 64 can be reduced without cost increase.

The verification experiments were carried out similarly to Embodiment 1. With the cleaning and charging blade 4 of this embodiment, no lateral stripes due to the charging non-uniformity are produced, similarly to Embodiment 3.

As described in the foregoing, in this embodiment, the cleaning portion 64 and the charge portion 51 of the charging and cleaning blade are mounted to the common supporting portion 63 without contact between the cleaning portion 64 and the charge portion 51, and the configuration of the supporting portion 63 is changed. By doing so, the uniform charging is accomplished independently of the vibration of the cleaning portion 64.

Embodiment 6

Figure 14:
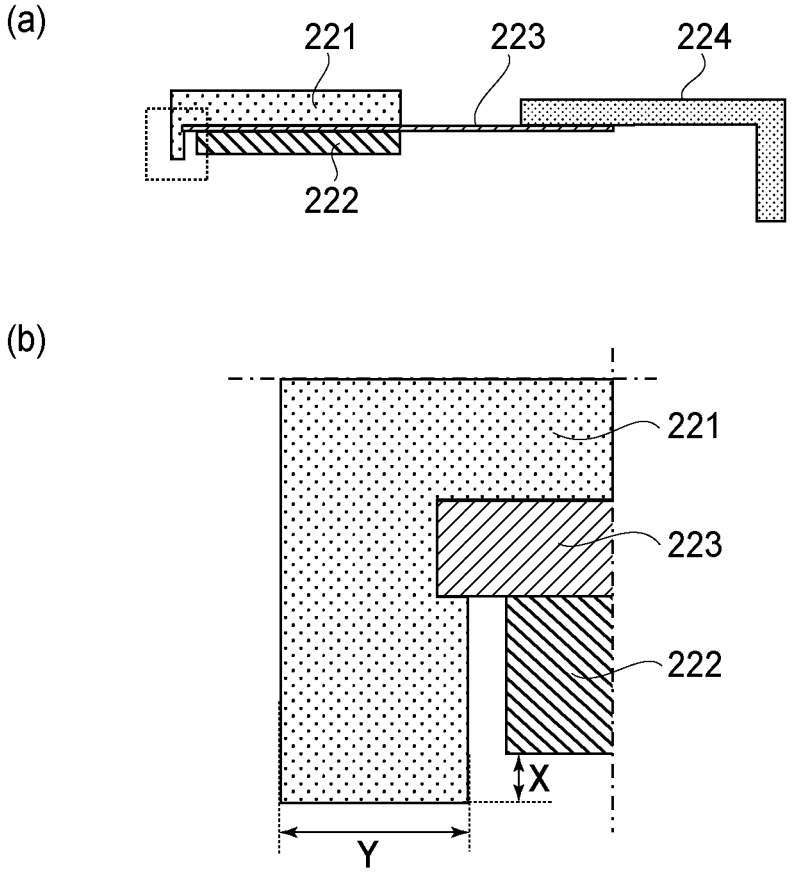
FIG. 14 is a schematic view of a charging and cleaning blade according to Embodiment 6.
Figure 15:
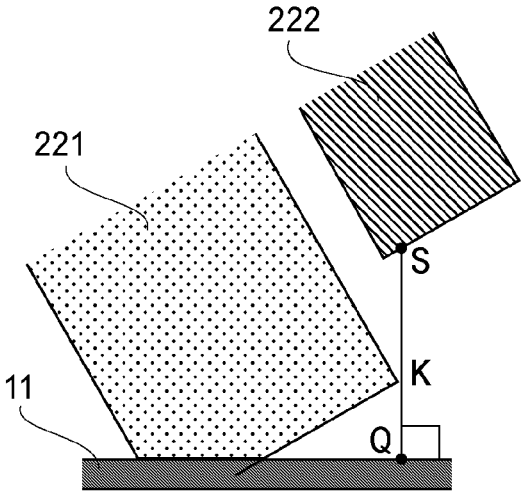
FIG. 15 shows a discharge region.

Referring to FIG. 14, part (a) is an illustration of a structure of a charging blade 4 according to this Embodiment 6, and part (b) is an enlarged view of a broken line portion H of part (a). FIG. 15 illustrates a contact state between the drum 3 and the charging blade 4. In this embodiment, the charging blade 4 is a cleaning and charging blade having functions of cleaning the drum 3 and charging the drum surface. The charging blade 4 comprises a non-charging portion (insulative portion 221) contacted to the drum 3 and cleaning it, a semiconductive charge portion 222, not contacted and closely disposed to the drum surface, for charging uniformly the drum surface by being supplied with a voltage.

The non-charging portion 221 is provided with a projected portion 221*a* to form a step such that the charge portion 222 is remote from the surface of drum 3 than the surface of the non-charging portion 221 contacting the drum 3. A width Y of the projected portion 221*a* is not less than 30 μm and not more than 200 μm. Along a line passing through a point K of the projected portion 221*a* at the downstreammost with respect to the moving direction (rotational moving direction) A of the drum, a line segment QS is closest between the drum 3 and the charge portion 222, and the length g of the line segment QS is not less than 7.5 μm and not more than 150 μm.

The length g of the line segment QS is the closest distance between the drum 3 and the charge portion 222, and the intersection between the line segment QS and the charge portion 222 is the closest position of the charge portion 222 to the drum 3. Designated by 223 is a supporting portion (supporting member) supporting the non-charging portion 221 and the charge portion 222, and 224 is a holder holding the supporting portion 223. The supporting portion 223 is made of electroconductive member in this embodiment, and is conducted electrically with the semiconductive charge portion 222, and an applied voltage for the charging is applied to the charge portion 222 through the supporting portion 223.

In this embodiment, the point S of the charge portion 222 which is on the extension of the normal line QK to the surface of drum 3 passing the point of the non-charging portion 221 of the charging blade 4. By making the point S on the charge portion 222 the closest position relative to the surface of the drum 3, the stabilized discharge is accomplished independently of the blade virtual bite 6.

In this embodiment, the length g of the line segment QS not less than 7.5 μm and not more than 150 μm. If the small gap g is less than 7.5 μm, the discharge does not occur as will be understood from the Paschen law. On the other hand, if the length g is not less than 150 μm, the discharge occurs, but the discharge is not uniform, and therefore, a defective image having spots results. Therefore, for the stabilized discharge, the gap g is desirably not more than 100 μm.

<Charge Portion 222>

The charge portion 222 comprises rubber such as epichlorohydrin rubber, EPDM in which electroconductive powder such as carbon black or metal oxide (zinc oxide, oxide titanium or the like) so as to provide a resistance value of 1×10^3-1×10^9 Ωcm.

If the resistance of the charging portion 222 is smaller than 1×10^3 Ωcm, the current leakage may occur when the drum 1 has a defect such as a pin hole, with the result of image defect white strips or black stripes. If, on the contrary, it is not less than 1×10^9 Ωcm, the attenuation of applied voltage is so large that the charging property is poor. Therefore, the resistance value of the charging portion 222 is desirably 1×10^3 Ωcm-1×10^9 Ωcm.

<Non-Charging Portion 221>

The non-charging portion 221 is contacted directly to the drum 3 at the free end portion of the charging blade 4, and as shown in part (b) of FIG. 14, the projected portion 221*a* is beyond the charge portion 222. In this embodiment, the non-charging portion 221 of the charging blade 4 is made of urethane rubber having a hardness of 72 degrees, and the projected portion 221*a* has a width Y=180 μm and a projection amount X=50 μm. An insulative rubber or the like silicone rubber is usable.

<Supporting Portion 223>

The supporting portion 223 is made of phosphor bronze (thickness t=0.1 mm) in this embodiment. As shown in (a) of FIG. 14, the supporting portion 223 is fixed to and supported by the holder 224, and is mounted to the casing of the cartridge 2. Alternatively, the supporting portion 223 may be of thin plate of SUS or the like. The holder 224 may be mounted to the main assembly of the image forming apparatus, or the supporting portion 223 may be directly fixed to and supported by the casing of the process cartridge 50 or by the main assembly of the image forming apparatus.

<Verification Experiment>

The durability tests were carried out with respect to the cleaning and charging blade 4 shown in FIG. 14, with the virtual bite δ=0.5 mm, 0.7 mm, 0.9 mm, 1.1 mm, 1.3 mm, 1.5 mm. Here, the cleaning function is a function of reducing the contamination of the charge portion 222 of the charging blade 4. The toner or the like passes by the cleaning blade 8*a* although the amount thereof is small, and therefore, it is prevented that it is deposited on the charge portion 222. For the purpose of comparison, the durability tests were carried out with respect to the charging blade 4 not employing the present invention Comparison example 1: X=0.05 mm, Y=0.4 mm (part (a) of FIG. 16)

Comparison example 2: X=0 mm, Y=0.4 mm (part (b) of FIG. 16)

Comparison example 3: X=0.02 mm, Y=0.02 mm (part (c) of FIG. 16)

Comparison example 4: X=0 mm, Y=0.02 mm (part (d) of FIG. 16)

Process speed: 100 mm/sec:

Photosensitive drum diameter: 24 mm

Cleaning blade 7 urethane rubber, counterdirectional contact:

Applied bias: DC-1050V:

Half-tone portion VH=−350V:

The results are shown taken in Table 1. With the image forming apparatus using the charging blade 4 of this embodiment, after 8000 sheets are processed, the charging property is maintained. In addition, in the similar durability test with process cartridges 2 having different blade virtual bites δ, the results are satisfactory. With the charging blades 4 of the comparison example 1-comparison example 4 not using this embodiment, the non-uniform charging image such as stripes are produced, the image quality significantly varies depending on the blade virtual bites δ, or no charging occurs in some cases.

TABLE 1

| Image Evaluation | | | | | | |
|---|---|---|---|---|---|---|
| | Virtual bite δ (mm) | | | | | |
| | 0.5 | 0.7 | 0.9 | 1.1 | 1.3 | 1.5 |
| Embodiment | F | G | G | G | G | F |
| Comparison Ex. 1 | NG | F | F | G | F | NG |
| Comparison Ex. 2 | F | G | G | F | NG | NG |
| Comparison Ex. 3 | NG | NG | NG | NG | NG | NG |
| Comparison Ex. 4 | NG | NG | NG | NG | NG | NG |

G: Good
F: Fair
NG: No good (stripes/no charging)

The causes of the facts are considered as follows.

Figure 16:
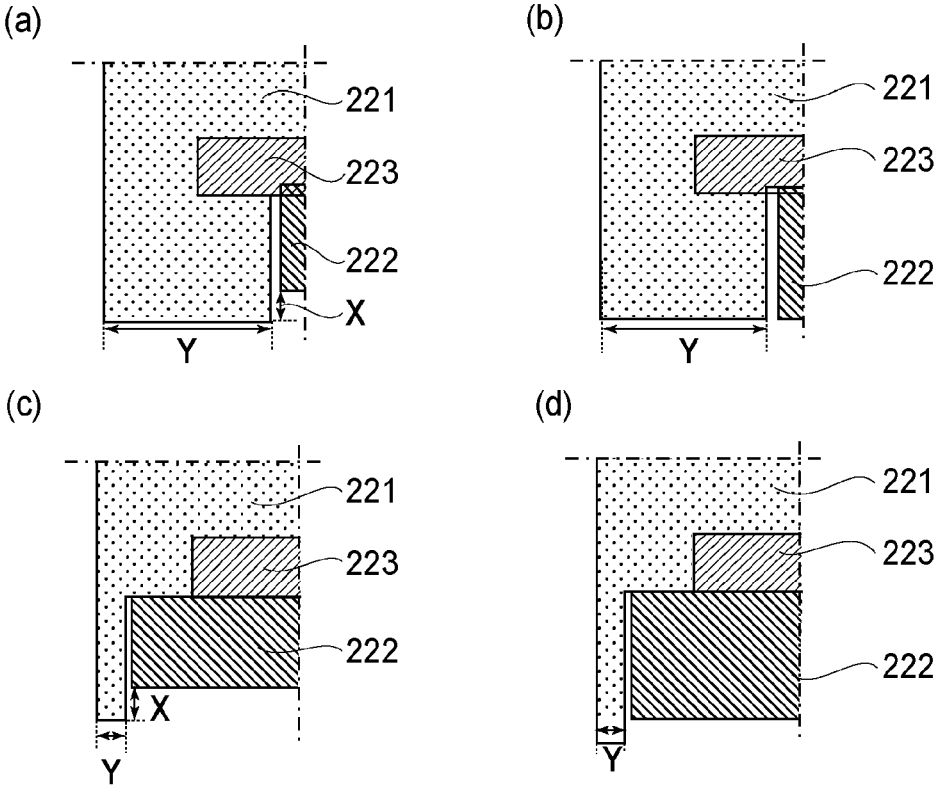
FIG. 16 shows a structure of a blade of comparison examples.

Comparison example 1: the width Y of the projected portion is wide as shown in part (a) of FIG. 16:

When the virtual bite δ of the charging blade 4 is small, the gap exceeds the dischargeable distance with the result of improper charging, and when the virtual bite δ=0.5 mm, no discharge occurs. When the virtual bite of the charging blade 4 is large, the nip width is so large that a free end pressure decreases as indicated by the broken lines in part (b) of FIG. 17, with the result of deterioration of the cleaning property. For this reason, due to increase of the toner or the like passed by the free end of the blade, the contamination of the charge portion 222 increases with the result of stripe images.

Comparison example 2: the width Y is large, and no projected portion is provided, as shown in part (b) of FIG. 16:

Similarly to the comparison example 1, when the virtual bite δ is small, δ=0.5 mm, spot images attributable to the non-uniformity charging property are slightly produced, but no practical problem arises. When the virtual bite δ of the charging blade 4 is large, stripe images attributable to the contamination of the charge portion are produced.

In comparison example 1 and comparison example 2, there is a range in which no image defect is observed, but as shown in Table 2, the variation of the gap distance depending on the difference of the blade virtual bite δ is large. Therefore, the variation in the charged state is unavoidable, and therefore, the image quality is not stabilized.

Comparison example 3: the width Y of the projected portion is small as shown in part (c) of FIG. 16

In the case that the virtual bite δ of the charging blade 4 is small, the nip width is so small that the proper cleaning property cannot be assured, and therefore, an amount of the toner or the like passed by the blade is very large with the result of contamination of the charge portion 222 with increase of the number of the processed sheets. When the virtual bite δ of the charging blade is not less than 0.7 mm, the projected portion is collapsed by the contact pressure of the blade with the result that contact between the charge portion 222 and the surface of the drum 3, and stripe images are produced.

Comparison example 4: the width Y is small, and no projected portion is provided as shown in part (d) of FIG. 16.

In the case that the virtual bite δ of the charging blade 4 is small, the proper cleaning property cannot be assured with the result of increase of the amount of the toner or the like passed by the blade, and the contamination of the charge portion 222 tends to result with increase of the number of the processed sheets. When the virtual bite δ of the charging blade 222 is large, the charge portion 222 contacts the drum surface, and with the virtual bite not less than 1.1 mm, the image defect in the form of stripes results with the increase of the number of the processed sheets.

Figure 17:
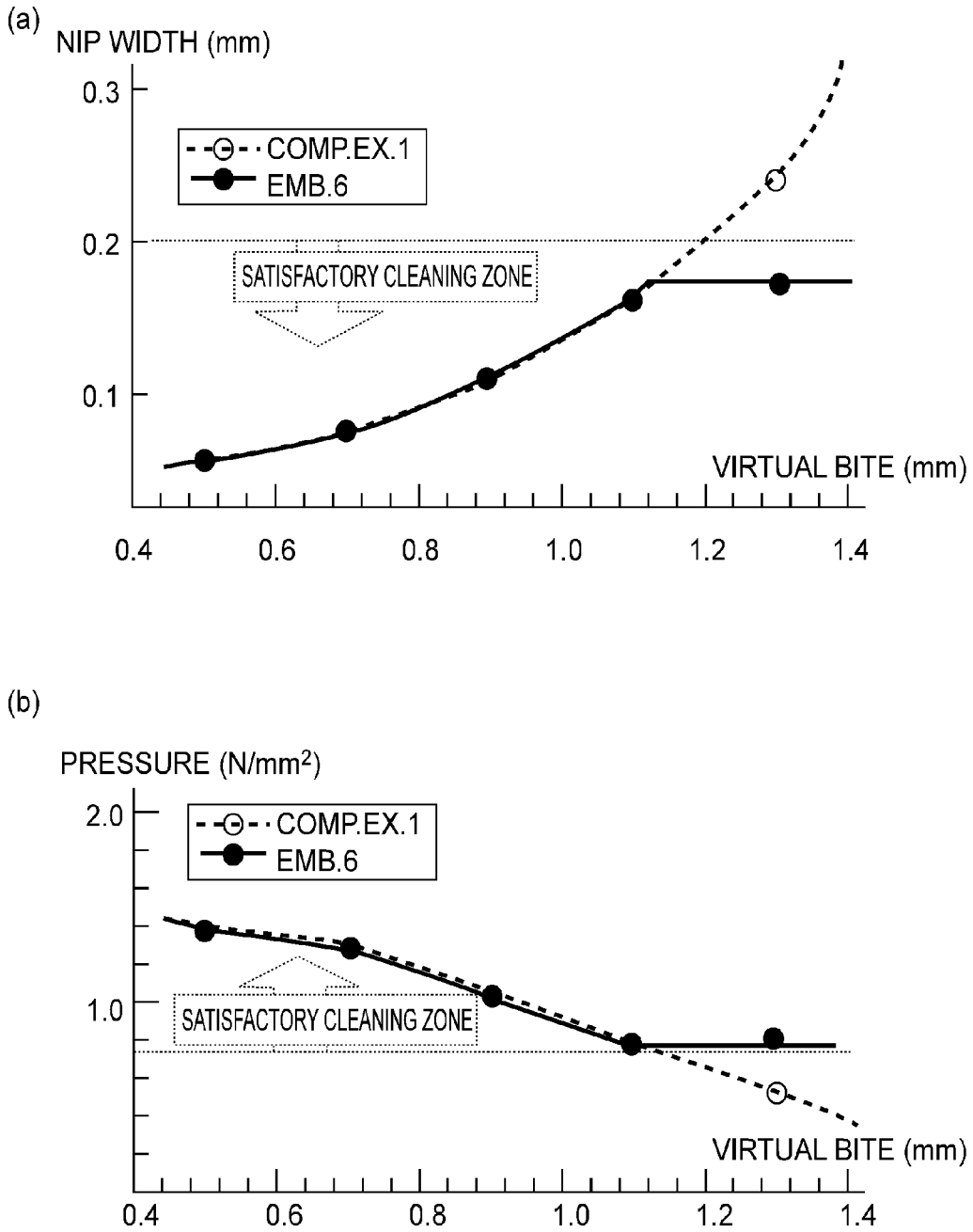
FIG. 17 illustrates results of the charging blade according to Embodiment 6.

In this embodiment, the width Y of the projected portion 221*a* is not less than 30 μm and not more than 200 μm, so that as indicated by the solid lines in FIG. 17, the nip width and the free end pressure which can provide the satisfactory cleaning property and free end pressure can be assured. Therefore, the amount of the toner or the like passed by the blade is so small that the contamination of the charge portion 222 can be significantly reduced, and therefore, the stripe images due to the contamination can be suppressed.

Figure 18:
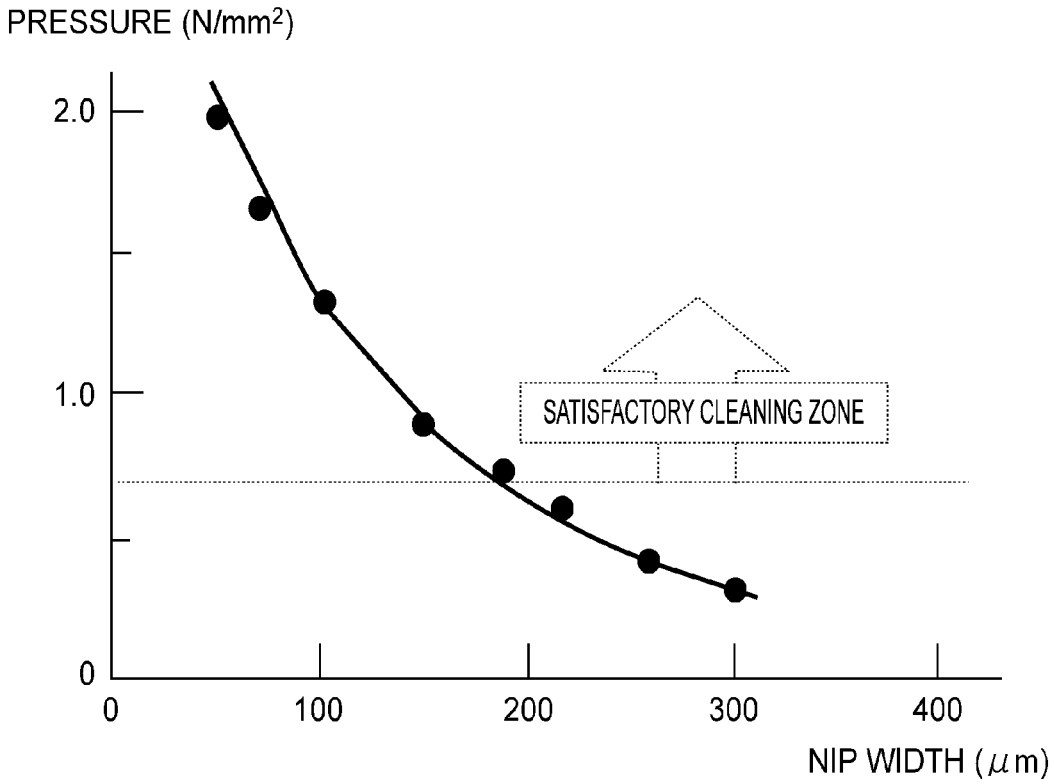
FIG. 18 describes an effect of a cleaning function in Embodiment 6.

The reason for this will be described. FIG. 18 shows a relationship between the nip width and a blade free end pressure. Here, the width Y of the projected portion 221*a* of the non-charging portion 221 is changed, a whole surface of the width Y of the projected portion 221*a* is press-contacted to the surface of the drum, and the blade virtual bite δ is constant at the δ=1.5 mm. As shown in FIG. 18, the free end pressure decreases with the increase of the nip width, and when the nip width is 300 μm, the free end pressure is not enough for the cleaning function.

In order to assure the free end pressure at all times, the nip width is desired to be not more than 200 μm. When the virtual bite becomes large due to the limitation of not more than 200 μm of the width Y of the projected portion 221*a*, the nip width of not more than 200 μm can be assured, and therefore, the free end pressure desired for the cleaning function can be assured.

As will be understood from Table 2, the variation of the gap between the charge portion 222 and the surface of drum 3 is 95 μm in comparison example 1, 97 μm in comparison example 2, but in this embodiment, it is 38 μm irrespective of the virtual bite δ of the blade. The reason for this will be described.

When the blade virtual bite is large, the gap is determined by the projection amount X of the non-charging portion 221, and therefore, when the virtual bite δ=1.1 mm, the gap distance is substantially=50 μm constant. In addition, when the virtual bite δ is small, the gap is smaller than in comparison example 1 and comparison example 2 since the charge portion 222 is close to the free end of the charging blade 4. Therefore, in this embodiment, the change amount of the gap distance relative to the change of the blade virtual bite δ can be made small, and therefore, the charging state is stabilized under the different blade virtual bites δ, and the stabilized output images are produced irrespective of the blade virtual bite δ.

TABLE 2

| | Gap | | | | | | |
|---|---|---|---|---|---|---|---|
| | Virtual bite δ (mm) | | | | | | Change of gap |
| | 0.5 | 0.7 | 0.9 | 1.1 | 1.3 | 1.5 | (δ0.5 – δ1.5) |
| Embodiment | 88 | 75 | 63 | 51 | 50 | 50 | 38 |
| Comparison Ex. 1 | 152 | 128 | 109 | 86 | 70 | 57 | 95 |
| Comparison Ex. 2 | 104 | 80 | 60 | 36 | 20 | 7 | 97 |
| Comparison Ex. 3 | 12 | 7 | 0 | 0 | 0 | 0 | 12 |
| Comparison Ex. 4 | 0 | 0 | 0 | 0 | 0 | 0 | 0 |
| | | | | | | | (μm) |

As described in the foregoing, according to the embodiment, the cleaning property is stabilized, the satisfactory output images can be produced stably irrespective of the setting (virtual bite) of the charging blade 4.

Embodiment 7

Figure 19:
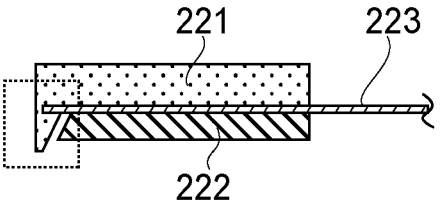
FIG. 19 is a schematic view of a charging blade according to Embodiment 7.
Figure 19:
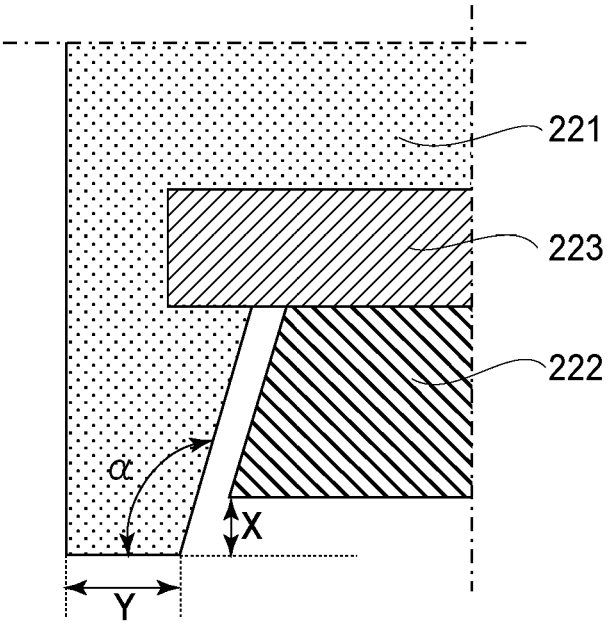

In this embodiment, the shape of the projected portion 221*a* is trapezoidal as shown in parts (a) and (b) of FIG. 19. In this Figure, part (b) is an enlarged view of a broken line portion H in part (a). Durability tests were carried out with respect to the cleaning and charging blade 4 of this embodiment in the same manner as with Embodiment 1. The charging blade 4 of this embodiment is provided with a projected portion 221*a* having a width Y=100 μm, and projection amount X=50 μm, and the angle α 90°, 110° or 130°. It is contacted to the drum 3 at a contact angle θ°=20°, and similarly to the Embodiment 1, the virtual bite δ is changed, and 8000 sheets are processed.

Table 3 shows the results.

TABLE 3

| | Virtual bite δ (mm) | | | | | |
|---|---|---|---|---|---|---|
| | 0.5 | 0.7 | 0.9 | 1.1 | 1.3 | 1.5 |
| α = 90° | F | G | G | G | G | F |
| α = 110° | G | G | G | G | G | G |
| α = 130° | F | F | G | G | G | G |

G: Good
F: Fair
NG: No good (stripes/no charging)

The result is that no image defect of stripe images are not produced until 8000 sheets are processed with the image forming apparatus using the charging blade 4 of this embodiment in any conditions. The causes of the facts are considered as follows.

Figure 20:
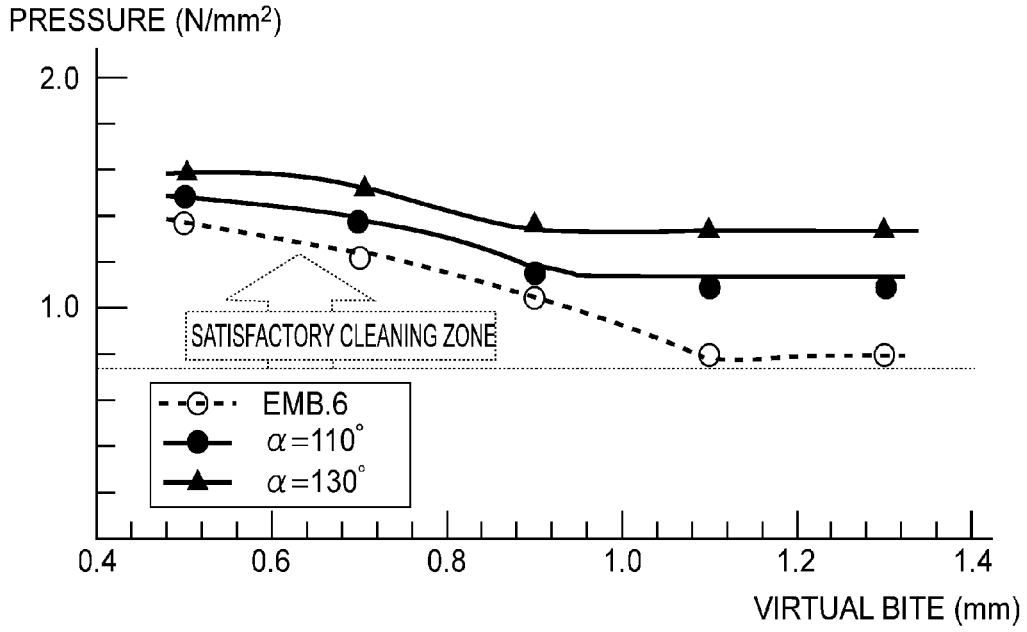
FIG. 20 is an illustration of an effect relates to a cleaning property of Embodiment 7.

As shown in part (b) of FIG. 19, by using the trapezoidal configuration having an angle α between a surface C and a surface D of the projected portion which is not less than 90 degrees, the strength of the non-charging portion 221 is enhanced. Therefore, particularly when the virtual bite δ of the charging blade 4 is as large as approx. δ=1.5 mm, the free end pressure can be further increased as compared with Embodiment 6 as shown in FIG. 20. Also when δ=0.5 mm, the free end pressure can be higher than in Embodiment 6, and therefore, the cleaning property is improved, thus reducing the contamination of the charge portion.

However, in the case of α=130°, the difference in the image quality depending on the difference of the blade virtual bite bis larger than the cases of α=90° and α=110°. As compared with the cases of α=90° and 110° as shown in part (a) of FIG. 21, a discharge region S is a region U which is remote from the free end of the blade in the case of α=130°, as shown in part (b) of FIG. 21. When the virtual bite is as large as δ=1.5 mm approx., the image quality is not different bet the angles α of 110° and 130° because the gap between the charge portion 222 and the surface of drum 3 is determined by the projection amount X of the non-charging portion 221.

Figure 21:
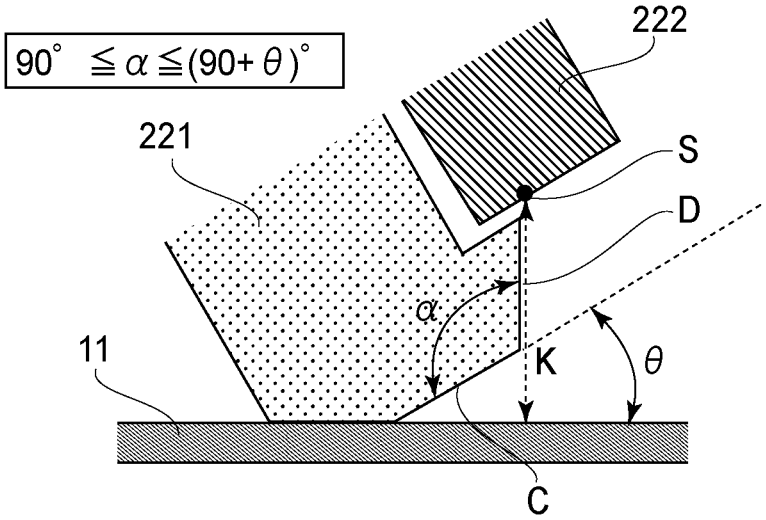
FIG. 21 illustrates an effect of the charging blade according to Embodiment 7 relating to a charging property.
Figure 21:
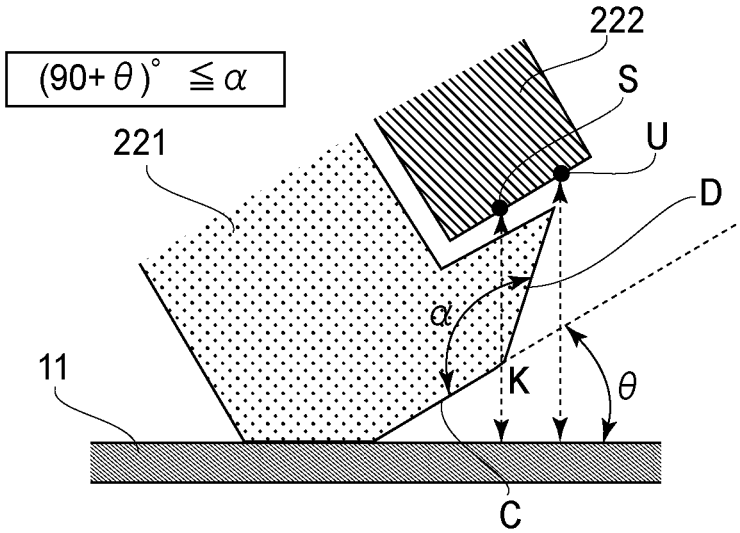

However, when the blade virtual bite is as small as δ=0.5 mm approx., the discharge region is as indicated by U in the case of α=130°, as shown in part (b) of FIG. 21, and as compared with the case of α=110°, the amount of change of the gap relative to the difference of the blade virtual bite δ is large. For this reason, a surface potential of the photosensitive drum 3 is different with the result of difference in the image quality.

From the foregoing, in this embodiment in which the contact angle θ° is 20°, the satisfactory output images are produced when the angle α=90°-110°. That is, when the contact angle is θ°, the angle α is not less than 90 degrees and not more than (90+θ) degrees. By doing so, the strength of the non-charging portion 221 increases, and the change amount of the gap between the charge portion 222 and the drum 3 is small, and therefore, the charging state is stabilized and satisfactory output images can be provided, irrespective of the blade virtual bite δ.

Suppose that an angle formed between the surface of the non-charging portion 221 which contacts the drum 3 (rotatable drum type image bearing member) and a tangent line of the drum 3 at the free end position of the charging member 4 contacting drum is θ degrees. The angle α formed between the surface of the non-charging portion 221 which contacts the drum 3 and a surface of the projected portion 221*a* which is continuous therewith and which is in the downstream side (with respect to the rotational moving direction of the image bearing member) satisfies not less than 90 degrees and not more than (90+θ) degrees. The As described in the foregoing, according to the embodiment, the cleaning property is stabilized, the satisfactory output images can be produced stably irrespective of the setting (virtual bite) of the charging blade 4.

Embodiment 8

Figure 22:
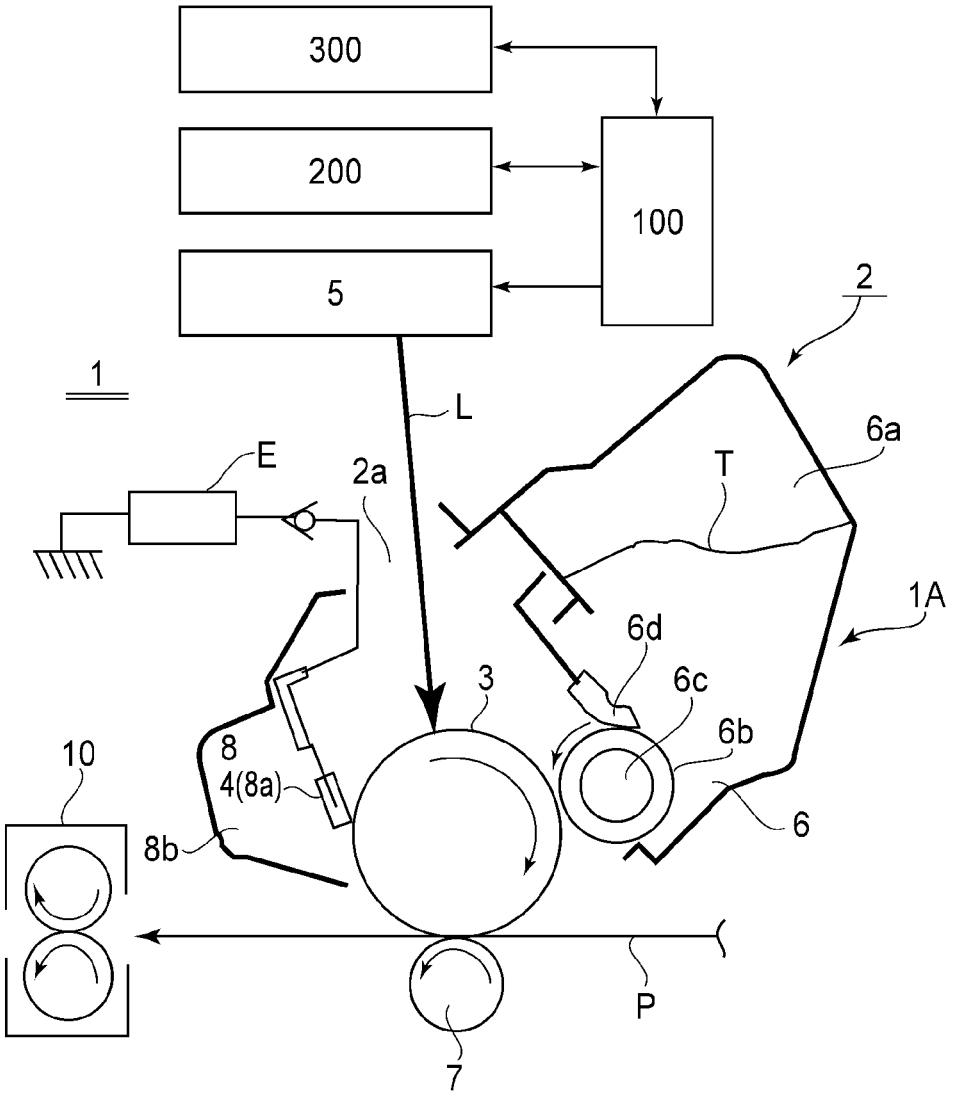
FIG. 22 is a schematic view of an image forming apparatus indicated by Embodiment 8.

As shown in FIG. 22, in this embodiment, the cleaning function of the charging blade is used as a cleaning means for the drum, and is a cleaning and charging blade. By this, the downsizing and cost reduction of the process cartridge 2 and the image forming apparatus 1 can be accomplished.

Durability tests were carried out with respect to the process cartridge 2 using the charging blade of this embodiment. The charging blade is provided with a projected portion 221*a* having a projection amount X=0.05 mm, a width Y=0.80 mm, and angle α°=105°. In the durability tests, the contact angle θ°=15°, the virtual bite δ=0.5 mm, 0.7 mm, 0.9 mm, 1.1 mm, 1.3 mm, 1.5 mm. Table 4 shows the results of the tests of 8000 sheet processing, wherein it is understood that a charging property and the cleaning property are satisfactory and the satisfactory images are produced until 8000 sheets.

TABLE 4

| | Virtual bite δ (mm) | | | | | |
|---|---|---|---|---|---|---|
| | 0.5 | 0.7 | 0.9 | 1.1 | 1.3 | 1.5 |
| Charging property | F | G | G | G | G | G |
| Cleaning property | F | G | G | G | G | F |

G: Good
F: Fair
NG: Non-uniform charging or insufficient cleaning

As described in the foregoing, according to the embodiment, the cleaning property is stabilized, the satisfactory output images can be produced stably irrespective of the setting (virtual bite) of the charging blade 4.

[Others]

1) the image bearing member on which the electrostatic latent image is formed is not limited to the electrophotographic photosensitive member for an electrophotographic type apparatus of the embodiments. It may be a dielectric member for electrostatic recording for an electrostatic recording type apparatus. The image bearing member is not limited to the drum type. It may be an endless rotatable belt, a traveling non-endless belt or the like. The image bearing member may be a sheet-like member (electro-facsimile machine paper, electrostatic recording paper) fed by a feeding means.

2) the relative movement between the image bearing member and the charging member is not limited to the case in which the image bearing member moves relative to the fixed charging member as in the foregoing embodiments, but the charging member may move relative to the fixed image bearing member, or both of the charging member and the image bearing member move with relative movement therebetween.

3) the contact of the charging member relative to the image bearing member is not limited to the counterdirectional contact as in the foregoing embodiments, but the codirectional contact may be employed. In addition, the edge contact is not inevitable, but convex contact can be employed.

4) in the present invention, the charging of the surface of the image bearing member by the charging member is not limited to applying the electric charge thereto, but includes the case of electrically discharging the image bearing member, that is, removing the electric charge from the image bearing member. In addition, the blade-like charging member of the present invention is usable as a cleaning charging blade.

While the invention has been described with reference to the structures disclosed herein, it is not confined to the details set forth and this application is intended to cover such modifications or changes as may come within the purpose of the improvements or the scope of the following claims.

What is claimed is:

1. A blade-like charging member for charging a surface of an image bearing member by contacting thereto and by being supplied with a voltage, said charging member comprising:

a charging portion for effecting electric discharge to the surface of the image bearing member;

a non-charging portion not effecting the electric discharge to the surface of the image bearing member, wherein said non-charging portion is provided at a free end portion of said blade-like charging member and is capable of contacting the image bearing member to provide a dischargeable gap between said charging portion and the image bearing member, and at least a part said non-charging portion is made of a substance having a resistance higher than that of said charging portion to prevent discharge from occurring from said non-charging portion to the surface of the image bearing member; and a supporting portion supporting said non-charging portion and said charging portion with space between said non-charging portion and said charging portion to prevent contact between said non-charging portion and said charging portion.

2. A charging member according to claim 1, wherein said non-charging portion extends in sliding contact with the surface of the image bearing member in a total width of an image forming region of the surface of the image bearing member.

3. A charging member according to claim 1, wherein said supporting portion is made of metal, and a voltage is applied to said charging portion through said supporting portion.

4. An image forming apparatus comprising said charging member according to claim 1, and a voltage source for applying a voltage to said charging member.

5. An image forming apparatus comprising an image bearing member of a rotatable drum type on which an electrostatic latent image is formed, a blade-like charging member according to claim 1 for charging a surface of said image bearing member, and a voltage source for applying a voltage to said charging member, wherein said non-charging portion is provided with a projected portion projecting toward said image bearing member beyond a surface of said charging portion, and wherein, when an angle formed between a surface of said non-charging portion that contacts said image bearing member and a tangent line of said image bearing member at a free end position of said charging member contacting said image bearing member is θ (>0) degrees, an angle α formed between said surface of said non-charging portion which contacts said image bearing member and a surface of said projected portion which is continuous therewith and which is in a downstream side with respect to a rotational moving direction of said image bearing member is not less than 90 degrees and not more than 90+θ degrees.

6. A charging member according to claim 1, wherein the resistance of said charging portion is $10^3$ Ωcm to $10^9$ Ωcm.

* * * * *